United States Patent [19]

Kirk

[11] 4,046,333

[45] Sept. 6, 1977

[54] YARN MINDER AND ORGANIZER

[76] Inventor: Walter Kirk, 18 Saucier St., Acushnet, Mass. 02743

[21] Appl. No.: 703,694

[22] Filed: July 8, 1976

[51] Int. Cl.[2] ..... B65H 49/18

[52] U.S. Cl. ..... 242/137.1

[58] Field of Search ..... 242/137, 137.1, 138, 242/140, 146; 206/388, 391, 392

[56] References Cited

U.S. PATENT DOCUMENTS

| | | | |
|---|---|---|---|
| 1,642,860 | 9/1927 | Lafin | 242/137.1 |
| 2,304,501 | 12/1942 | Hommer | 242/137.1 |
| 2,519,505 | 8/1950 | Rollins | 242/137.1 |

*Primary Examiner*—Leonard D. Christian

[57] ABSTRACT

A yarn minder and organizer having a holder adapted to be used in conjunction with skeins in a container is provided with cover means adapted to extend across the open end of the container, with coupling means operatively connected to the cover means to retain the cover means in a relatively fixed position with respect to the container when the holder is utilized. Access means to the container is obtained by providing a plurality of spaced apart openings extending through the cover means to permit the user to view the skeins positioned in the container, and guide means is operatively associated with each of the access means to permit the user to withdraw yarn from each skein independently. The holder is formed with the cover means including a hub portion centrally located on the cover means, having a plurality of sprockets extending outwardly from the hub portion, and a rim portion integrally formed with the sprockets. The spacing between the respective sprockets defining the access means in the form of an opening to permit access to the container therethrough. The coupling means includes a circumferentially downwardly extending lip portion adapted to extend in telescoping relationship to the open end of the container.

4 Claims, 2 Drawing Figures

YARN MINDER AND ORGANIZER

BACKGROUND OF THE INVENTION

This invention relates to a device designed for the storage and convenient use of skeins of embroidery floss, the skeins being of the type available in commercial establishments in standard sizes and used for embroidery work.

In actual practice, in needlecraft, crewel, etc., the worker uses up to six different colors of yarn and the yarn is generally precut to various lengths to be used by the user. The quantity of yarn, etc., put up after it is taken from the reel in a loose twisted loop is a skein and it is important that one have the ability to unwind the skein as desired.

Although prior attempts have been made in providing a skein holder, they have generally found to be unsatisfactory to permit the unwinding of the skein in an easy manner.

OBJECTS OF THE INVENTION

An object of the present invention is to provide a skein holder adapted to contain a plurality of skeins and allow easy removal of one thread at a time without entangling the other skeins contained proximate thereto.

Another object of the present invention is to provide a skein holder that permits the user to keep the yarn organized and separated by color from each other.

Another object of the present invention is to provide a holder of particularly simple construction capable of manufacture from a molded plastic part.

Other objects and advantages of the present invention will become apparent as the disclosure proceeds.

SUMMARY OF THE INVENTION

A holder adapted to be used in conjunction with skeins in a container is provided including cover means adapted to extend across one end of the container, with coupling means operatively connected to the cover means to retain the cover means in a relatively fixed position with respect to the container is disclosed. Access means including a plurality of spaced apart openings extending through the cover means to permit the user to view the skeins positioned in the container, and guide means operatively associated with each of the access means to permit the user to withdraw yarn from each skein independently is provided.

The holder is formed with the cover means including a hub portion centrally located on the cover means, having a plurality of sprockets extending outwardly from the hub portion, and a rim portion integrally formed with the sprockets, the spacing between the respective sprockets defining the access means in the form of an opening to permit access to the container therethrough. The coupling means includes a circumferentially downwardly extending lip portion adapted to extend in telescoping relationship to the open end of the container.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
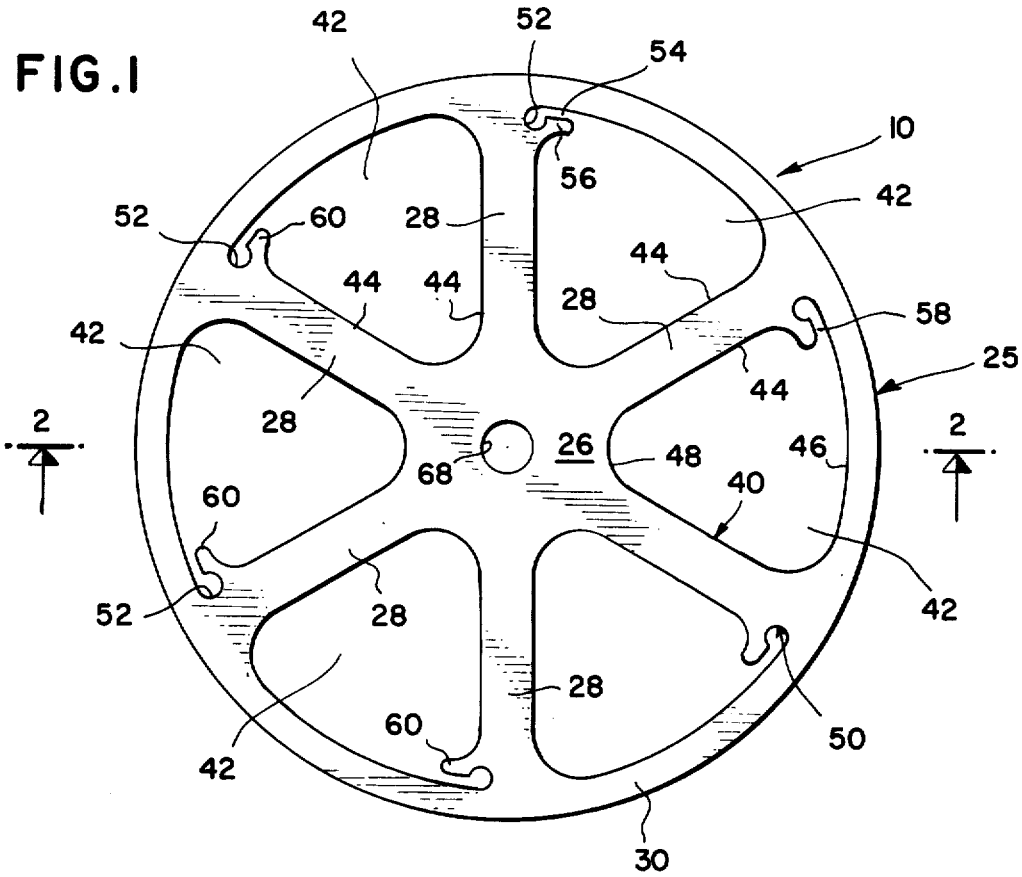
FIG. 1 is a top plan view of a holder formed according to the present invention.
Figure 2:
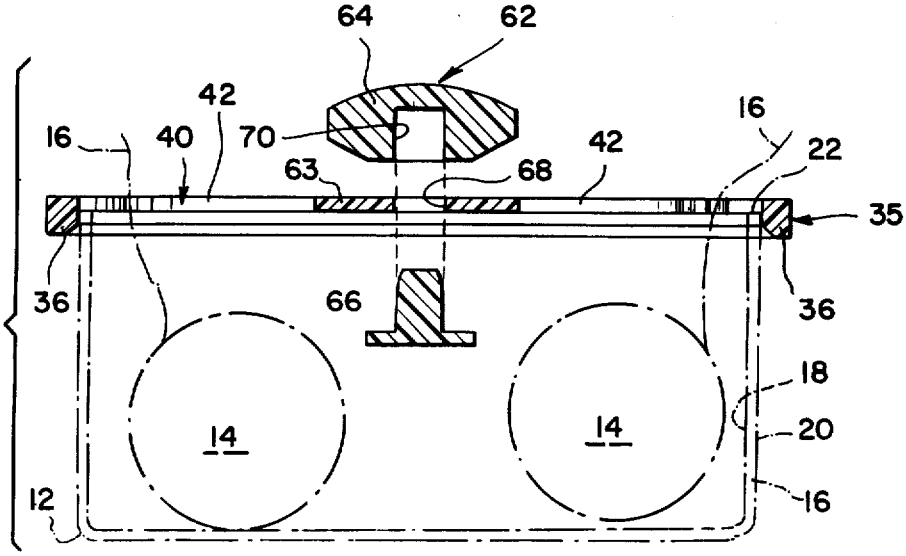
FIG. 2 is a sectional view taken along line 2—2 of FIG. 1, illustrating the holder mounted relative to a container in which the skeins are positioned.

Referring to FIGS. 1 and 2 of the drawings, there is illustrated a holder 10 adapted to be used in conjunction with a container 12 having a plurality of skeins 14 positioned therein with the individual thread of yarn 16 extending outwardly therefrom. The container 12 may have upwardly extending side wall 16 having an inner surface 18 and outer surface 20 for receiving thereon at the upper end 22 the holder 10 in removably fixed relation thereto.

The holder 10 includes cover means 25 that is adapted to extend across the open end of the container 12 and may include a centrally located hub portion 26 with a plurality of outwardly extending sprockets 28 that may be formed with a rim portion 30 that circumferentially connects all of the respective sprockets 28 together.

To permit the cover means 25 to remain removably secured to the container 12, coupling means 35 is provided as seen in FIG. 2 and may include a downwardly projecting lip portion 36 adapted to snugly engage the outer surface 20 of the wall 16 of the container 12. This permits the user to snap the cover means 25 onto or off of the container 12.

Access means 40 is provided in operative relationship to the respective skeins 14 and may include a plurality of spaced apart openings 42, six being illustrated, that are in equally spaced apart relation to each other and permit the user to view the skeins 14 positioned in the container 12. The openings 42 may be defined by the side walls 44 of each sprocket 28 as well as the inner wall 46 of the rim 30 and the exterior wall of the hub 26.

Guide means 50 is operatively associated with each opening 42 of the access means 40 to permit the user to gradually withdraw the yarn 16 from each skein 14 independently. Each sprocket 28 contains at substantially one end a guiding aperture 52 adapted for the yarn 16 to extend therethrough. A passageway 54 extends outwardly from each aperture 52 which essentially forms a seat for the yarn therein and the passageway 54 being narrower than the opening defined by the aperture 52. The passageway 54 is formed by a neck member 56 extending outwardly from each sprocket 28 adjacent the rim portion 30. The walls of the passageway 54 are formed by the inner rim wall 46 and a passageway wall 58 extending in substantially spaced relation to the rim wall 46. Each neck member 56 may have a contoured or rounded front end 60 that is adapted to permit the yarn to be easily placed through the passageway into the aperture 52.

To facilitate the user in removing the holder 10 from its position on the container 12 gripping means 62 is secured to the upper or front end 63 of the cover means 25 and includes a handle 64 and a fastener 66 having a portion that extends through a hole 68 in the cover means 25 and within a recess 70 axially extending in the handle or cap 64.

The holder 10 may be integrally formed from plastic material as by injection molding and provides for the user a simple manner in which to withdraw yarn 16 from a variety of skeins 14. The number of skeins 14 adapted to be contained in the container is a matter of choice and accordingly the size and shape of the container will vary with respect thereto.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A holder adapted to be used in conjunction with skeins in a container, comprising:

a. cover means adapted to extend across one end of the container;

b. coupling means operatively connected to said cover means to retain said cover means in a relatively fixed position with respect to the container;

c. access means including a plurality of spaced apart openings extending through said cover means to permit the user to view the skeins positioned in the container;

d. guide means operatively associated with each of said access means to permit the user to withdraw yarn from each skein independently;

e. said cover means includes:

1. a hub portion centrally located on said cover means;

2. a plurality of integrally formed sprockets extending outwardly from said hub portion; and 3. a rim portion integrally formed with said sprockets, said spacing between said respective sprockets defining said access means in the form of said openings to view the skeins positioned in the container;

f. said coupling means includes a circumferentially downwardly extending lip portion adapted to extend in telescoping relationship to the open end of the container, and g. said guide means includes:

1. a plurality of apertures, each aperture associated with a respective sprocket; and 2. a passageway communicating between each said aperture and said opening of said access means to permit yarn to be substantially retained within said aperture and removed through said passageway by the user.

2. A holder as defined in claim 1, wherein each said passageway is formed by a neck member extending outwardly from each sprocket adjacent said rim portion so that the rim portion defines one wall of said passageway.

3. A holder as defined in claim 2, and further including gripping means secured to said cover means to facilitate lifting of the holder from the container.

4. A holder defined in claim 2, wherein the holder is integrally formed of a plastic material.

* * * * *